US006442759B1

(12) United States Patent
Straham, Jr. et al.

(10) Patent No.: US 6,442,759 B1
(45) Date of Patent: Sep. 3, 2002

(54) MULTI-PURPOSE BABY BIB

(76) Inventors: Milton Straham, Jr., 2106 W. Stewart Ave., Flint, MI (US) 48504; Dimitri J. Straham, 2106 W. Stewart Ave., Flint, MI (US) 48504

( * ) Notice: Subject to any disclaimer, the term of this patent is extended or adjusted under 35 U.S.C. 154(b) by 0 days.

(21) Appl. No.: 09/932,689

(22) Filed: Aug. 16, 2001

Related U.S. Application Data

(60) Provisional application No. 60/239,190, filed on Oct. 9, 2000.

(51) Int. Cl.[7] ..... A41B 13/10
(52) U.S. Cl. ..... 2/49.1; 2/49.2; 2/49.4
(58) Field of Search ..... 2/49.1, 49.2, 49.3, 2/49.4, 48, 50, 52, 51, 102, 49.5, 94, 75, 80, 111; D2/861, 862, 863, 864

(56) References Cited

U.S. PATENT DOCUMENTS 2,250,887 A * 7/1941 Brown ..... 2/49
2,448,076 A * 8/1948 Bradley ..... 2/49.3
2,670,469 A * 3/1954 Danziger ..... 2/52
2,766,456 A * 10/1956 Nigro ..... 2/49.4
3,879,762 A * 4/1975 Herman ..... 2/48
4,068,313 A * 1/1978 Goldman ..... 2/49 R
4,694,510 A * 9/1987 Kamrath ..... 2/49.1
4,719,650 A * 1/1988 Milloy ..... 2/49 R
D300,281 S * 3/1989 Coates ..... D2/863
D326,918 S * 6/1992 Roberts ..... D24/194
5,815,834 A * 10/1998 Bronson ..... 2/102
5,898,940 A * 5/1999 Cameron ..... 2/49.1
5,960,471 A * 10/1999 Burton ..... 2/48
6,055,667 A * 5/2000 Jimenez ..... 2/49.1
6,209,133 B1 * 4/2001 Hinshaw ..... 2/49.1
6,209,134 B1 * 4/2001 Schiesel ..... 2/49.1

* cited by examiner

*Primary Examiner*—Amy B. Vanatta
(74) *Attorney, Agent, or Firm*—Joseph N. Breaux

(57) ABSTRACT

A bib which provides a mechanism for securing accessories such as teethers, rattles, pacifiers, toys, etc. to the front of the multi-purpose baby bib.

2 Claims, 2 Drawing Sheets

MULTI-PURPOSE BABY BIB

This application claims the benefit of U.S. Provisional Application No. 60/239,190 filed on Oct. 9, 2000.

TECHNICAL FIELD

The present invention relates to baby accessories and more particularly to a multi-purpose baby bib that includes a bib structure constructed from a moisture proof material layer and absorbent material front and back layers; the bib structure being constructed in a conventional reversible bib format having a neck opening defined by a pair of connecting members; the multi-purpose baby bib further including an accessory attachment strap attached to the bib structure at a first strap end and including a second strap end provided with a connecting mechanism for attaching accessories such as toys, rattles, pacifiers, liquid filled chilled teethers, etc. securely to the strap; in a preferred embodiment the multi-purpose baby bib has a pocket sized and positioned for catching dropped or spilled food items and the like as well as for holding an accessory secured to the end of the strap when the accessory is not being used; in another preferred embodiment the accessory attachment strap is attached to the multi-purpose baby bib with a detachable fastener mechanism. When the detachable fastener mechanism is detached from the multi-purpose bib, the accessory attachment strap is provided with a second fastener portion such that the fastener mechanism may be used to secure the first strap end of the accessory attachment strap around and to items such as shopping cart handles, play pen rails, car seat hand grips etc. while the second strap end is securing the accessory.

BACKGROUND OF INVENTION

It is often desirable to have baby accessories such as teethers, rattles, pacifiers, toys, etc. for children's entertainment and development. It would be a benefit, therefore, to have a bib which provided a mechanism for maintaining such accessories in a readily reachable location.

SUMMARY OF INVENTION

It is thus an object of the invention to provide a multi-purpose baby bib that includes a bib structure constructed from a moisture proof material layer and absorbent material front and back layers; the bib structure being constructed in a conventional reversible bib format having a neck opening defined by a pair of connecting members; the multi-purpose baby bib further including an accessory attachment strap attached to the bib structure at a first strap end and including a second strap end provided with a connecting mechanism for attaching accessories such as toys, rattles, pacifiers, liquid filled chilled teethers, etc. securely to the strap; in a preferred embodiment the multi-purpose baby bib has a pocket sized and positioned for catching dropped or spilled food items and the like as well as for holding an accessory secured to the end of the strap when the accessory is not being used; in another preferred embodiment the accessory attachment strap is attached to the multi-purpose baby bib with a detachable fastener mechanism. When the detachable fastener mechanism is detached from the multi-purpose bib, the accessory attachment strap is provided with a second fastener portion such that the fastener mechanism may be used to secure the first strap end of the accessory attachment strap around and to items such as shopping cart handles, play pen rails, car seat hand grips etc. while the second strap end is securing the accessory.

Accordingly, a multi-purpose baby bib is provided. The multi-purpose baby bib includes a bib structure constructed from a moisture proof material layer and absorbent material front and back layers; the bib structure being constructed in a conventional reversible bib format having a neck opening defined by a pair of connecting members; the multi-purpose baby bib further including an accessory attachment strap attached to the bib structure at a first strap end and including a second strap end provided with a connecting mechanism for attaching accessories such as toys, rattles, pacifiers, liquid filled chilled teethers, etc. securely to the strap; in a preferred embodiment the multi-purpose baby bib has a pocket sized and positioned for catching dropped or spilled food items and the like as well as for holding an accessory secured to the end of the strap when the accessory is not being used; in another preferred embodiment the accessory attachment strap is attached to the multi-purpose baby bib with a detachable fastener mechanism. When the detachable fastener mechanism is detached from the multi-purpose bib, the accessory attachment strap is provided with a second fastener portion such that the fastener mechanism may be used to secure the first strap end of the accessory attachment strap around and to items such as shopping cart handles, play pen rails, car seat hand grips etc. while the second strap end is securing the accessory.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY EMBODIMENTS

Figure 1:
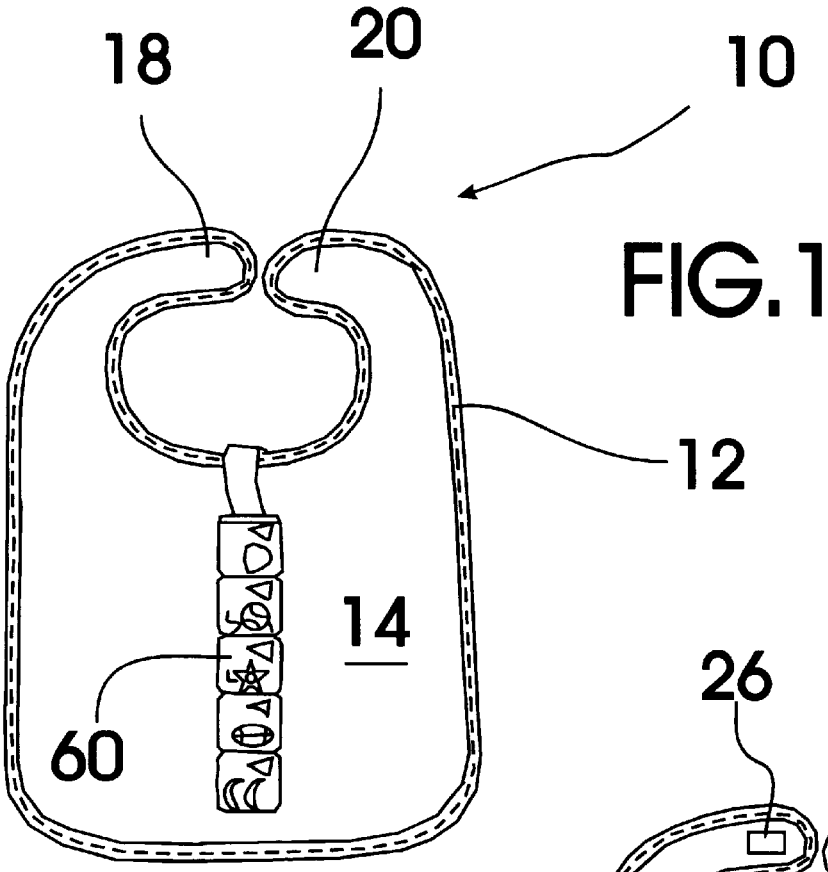
FIG. 1 is a front plan view of an exemplary embodiment of the detachable multi-purpose baby bib of the present invention.
Figure 2:
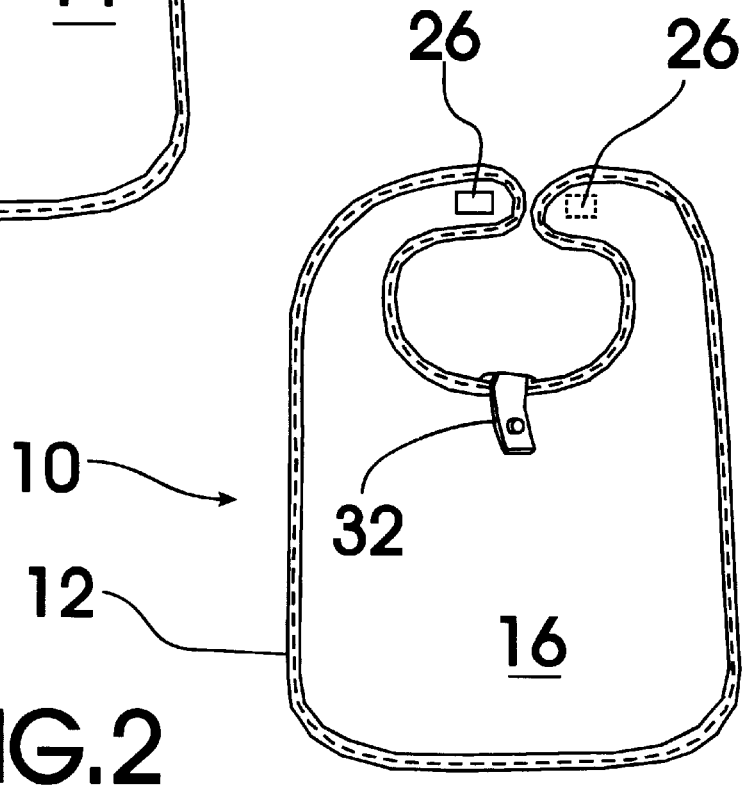
FIG. 2 is a back plan view of the detachable multi-purpose baby bib of FIG. 1 and FIG. 4.
Figure 3:
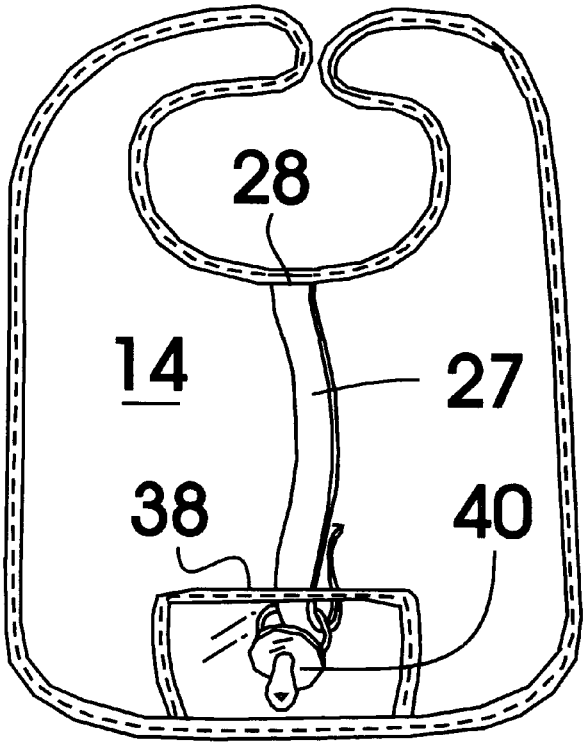
FIG. 3 shows a second exemplary embodiment of the multi-purpose baby bib with the strap permanently sewn to the front of the bib surface and a pocket provided for catching fallen food items and/or holding an accessory attached to the strap, such as a pacifier, toy, rattle, etc., when the accessory is not being used.
Figure 4:
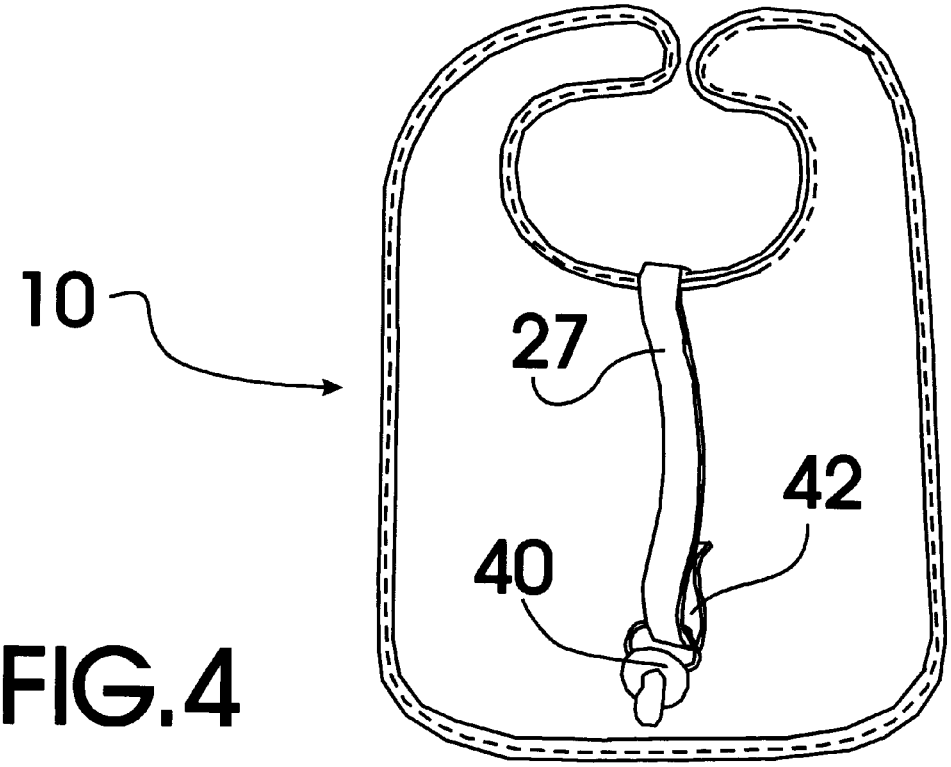
FIG. 4 shows an exemplary embodiment of the multi-purpose baby bib with a pacifier attached to the end of detachable strap.

FIGS. 1 through 4 show various aspects of exemplary embodiments of the multi-purpose baby bib of the present invention generally designated 10. Multi-purpose baby bib 10 includes a bib body 12 including an absorbent front surface 14, an absorbent back surface 16 separated from absorbent front surface 14 by a moisture proof layer, and a pair of connectable neck encircling members 18, 20 that are attachable with connection mechanisms, in this embodiment the connection mechanisms are snaps 26. An accessory connecting strap 27 is attached to the neck portion 28 either permanently by stitching along the neck portion 28 as shown in FIG. 3 or detachably connectable to a back surface 16 with a snap mechanism 32. If desired, a pocket portion 38 can be provided on front surface 14 for storing entertainment accessories such as a pacifier 40 therein which is attached to the end loop 42 of strap 27. Pocket 38 is positioned at the bottom of front surface 14 for catching dropped or spilled food items. Pocket 38 may also be used for storing an accessory attached to connecting strap 27 when the accessory is not being used. In this embodiment, the detachable liquid filled teether strap 60 may be frozen or chilled to provide the child with a soothing device for soothing swollen gums as the result of teething.

It can be seen from the preceding description that a multi-purpose baby bib has been provided.

It is noted that the embodiment of the multi-purpose baby bib described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A multi-purpose baby bib comprising:

a bib structure constructed from a moisture proof material layer and absorbent material front and back layers;

the bib structure being constructed in a reversible bib format having a neck opening defined by a pair of connecting members;

the multi-purpose baby bib further including an accessory attachment strap detachably attached to a back surface of the bib structure at a first strap end with a snap mechanism and having a second strap end provided with a liquid filled teether;

the accessory attachment strap being detachable to allow the liquid filled teether to be chilled in a refrigerator or frozen in a freezer, as desired by the user, without having to chill the bib structure.

2. The multi-purpose baby bib of claim 1 further comprising:

a pocket, sized and positioned for catching dropped or spilled items.

* * * * *